US006705699B2

(12) United States Patent
Du et al.

(10) Patent No.: US 6,705,699 B2
(45) Date of Patent: Mar. 16, 2004

(54) IMAGE OUTPUT DEVICE FOR IMPROVING IMAGE RESOLUTION AND TONE EXPRESSION

(75) Inventors: Ben-Chuan Du, Shindian (TW); Yung-Yi Li, Yungkang (TW)

(73) Assignee: Benq Corporation (TW)

( * ) Notice: Subject to any disclaimer, the term of this patent is extended or adjusted under 35 U.S.C. 154(b) by 0 days.

(21) Appl. No.: 10/135,401

(22) Filed: May 1, 2002

(65) Prior Publication Data

US 2002/0163557 A1 Nov. 7, 2002

(30) Foreign Application Priority Data

May 3, 2001 (TW) ..... 90110667 A

(51) Int. Cl.[7] ..... B41J 2/145; B41J 2/15; B41J 2/14; B41J 2/16

(52) U.S. Cl. ..... 347/40; 347/47

(58) Field of Search ..... 347/40, 43, 47

(56) References Cited

U.S. PATENT DOCUMENTS 5,521,622 A * 5/1996 Hock et al. ..... 347/43
5,949,454 A * 9/1999 Nozawa et al. ..... 347/45
6,149,260 A 11/2000 Minakuti ..... 347/15
6,303,274 B1 * 10/2001 Chen et al. ..... 430/320

FOREIGN PATENT DOCUMENTS

DE 69316432 11/1993

* cited by examiner

*Primary Examiner*—Thinh Nguyen
(74) *Attorney, Agent, or Firm*—Rabin & Berdo, PC

(57) ABSTRACT

An image output device includes two color ink cartridges. The first color ink cartridge is filled with yellow ink, magenta ink, and cyan ink. Besides, the yellow ink nozzle, first magenta ink nozzle, first cyan ink nozzle eject the yellow ink, magenta ink, and cyan ink respectively. The second color ink cartridge is filled with black ink, magenta ink, and cyan ink. Besides, the black ink nozzle, second magenta ink nozzle, and second cyan ink nozzle ejects the black ink, magenta ink, and cyan ink respectively. The second magenta ink nozzle has a diameter smaller that of the first magenta ink nozzle, and the second cyan ink nozzle has a diameter smaller that of the first cyan ink nozzle. The color ink cartridge ink having the nozzle with small diameter is driven to create small ink drops or light ink drops. It improves the image resolution and creates a six-color tone expression. Moreover, the cost of manufacturing the print-head will not increase and the controlling method will not become complicated.

11 Claims, 3 Drawing Sheets

IMAGE OUTPUT DEVICE FOR IMPROVING IMAGE RESOLUTION AND TONE EXPRESSION

This application incorporates by reference Taiwan application Serial No. 090110667, filed May 3, 2001.

BACKGROUND OF THE INVENTION

1. Field of the Invention

The invention relates in general to an image output device, and more particularly to an image output device for improving image resolution and tone expression.

2. Description of the Related Art

In recent years, the personal computer has become so popular that the peripheral computer products have developed very rapidly. Most users employ printers to create output images by printing the electrical documents, such as plain text, colorful graphics, or beautiful pictures, which might be downloaded from the Internet or photographed by a digital camera. By balancing the price and quality, the color ink-jet printer is an affordable option for most PC buyers and has thus become the most popular type of printer sold today.

In the ink-jet printer, a print head traverses over the surface of the paper and ejects ink onto the paper to form a printed image. The bubble jet and piezoelectric print head technologies are widely applied to ink-jet printers now to produce bubble jet printers and piezoelectric printers. The principal difference between bubble-jet printers and piezoelectric printers is that bubble-jet printers use special heating elements to prepare the ink, and the piezoelectric printers use piezoelectric crystals. In substance, the piezoelectric printer uses the expanding piezoelectric crystals to force ink drops out of the nozzle and onto the paper. Usually, the bubble jet printer includes a heating element, ink, and nozzle. The heating element heats the ink and forms a bubble until the pressure forces it to burst. A drop of ink is then forced out of the nozzle and onto the paper. During printing, it is required that the ink density and dropping location be controlled to form the desired printed image.

The printed image is a pattern consisting of a number of ink drops or pixels. The print quality relates to the resolution. Generally speaking, the higher the resolution, the more pixels per square inch an image has, and the better the overall print quality. For example, if the resolution of 600*600 dpi (dot per inch) increases to the resolution of 1200*600 dpi, the ink drop size decreases a half time accordingly. The U.S. Pat. No. 5,726,690 discloses a method for controlling the ink drop size by controlling the pulse width of the delivered firing pulse. However, the variation range of the ink drop size is only 16% by the method, which does not improve the resolution very much.

Another key factor of print quality for a color ink-jet printer is the tone expression. The traditional color ink-jet printer uses ink of four colors, M (Magenta), C (Cyan), Y (Yellow), and K (Black). In recent years, the color ink-jet printer uses ink of six colors including M, C, Y, K, light M, and light C, or even uses ink of seven colors by adding light Y. Therefore, the tone expression can enrich the color of the printed image. In a printer having six color inks, the printed image can have $2^5$=32 kinds of color combinations without the shortcoming of half tone simulation and the print quality will greatly improve. Therefore, the key factor of print quality for a color ink-jet printer is the number of the color combinations, that is to say, the tone expression.

The following statement is about the improvement on the variation range of the ink drop size (resolution) and the number of the color combination (tone expression) regarding the conventional image output device with ink of four/six colors.

Referring to FIG. 1, an arrangement for a nozzle of the conventional image output device with ink of four colors is shown. The conventional image output device with ink of four colors includes a color ink cartridge 110 and a black ink cartridge 140. The color ink cartridge 110 has a yellow ink tank Y filled with yellow ink 112, magenta ink tank M filled with magenta ink 114, and cyan ink tank C filled with cyan ink 116. The small circles near the ink tanks represent the nozzle of the printhead for ejecting ink. The yellow ink nozzle 122 is capable of ejecting yellow ink 112, the magenta ink nozzle 124 is capable of ejecting magenta ink 114, and the cyan ink nozzle 126 is capable of ejecting cyan ink 116. The black ink cartridge 140 only has a black ink tank K filled with the black ink 142, and the black ink nozzle 152 is capable ejecting black ink 142.

Referring to FIG. 2, another arrangement for nozzle of the conventional image output device with ink of four colors is shown. The U.S. Pat. No. 6,149,260 discloses an ink jet recording apparatus capable of printing different dot sizes by using a large size nozzle and a small size nozzle to increase the variation range of the ink drop size. As shown in FIG. 2, the conventional image output device with ink of four colors includes a color ink cartridge 210 and a black ink cartridge 240. The color ink cartridge 210 has a yellow ink tank Y filled with yellow ink 212, magenta ink tank M filled with magenta ink 214, and cyan ink tank C filled with cyan ink 216. The yellow ink nozzles 222, 232 are capable of ejecting yellow ink 212, the magenta ink nozzles 224, 234 are capable of ejecting magenta ink 214, and the cyan ink nozzles 226, 236 are capable of ejecting cyan ink 216. The black ink cartridge 240 only has a black ink tank K filled with the black ink 242, and the black ink nozzle 252 is capable ejecting black ink 242.

In FIG. 2, the color cartridge 210 has nozzles with a large diameter and a small diameter. The nozzle with small diameter will be driven to eject the small ink drop or light ink drop. The nozzle with large diameter will be driven to eject the large ink drop or dark ink drop. The ejected ink has a proper size and color since the variation range of the ink drop size is increased. However, it requires a larger wafer for forming nozzles with different diameters on one printhead. Besides, the cost of manufacturing the printhead increases and the controlling method becomes more complicated. Although the ink jet recording apparatus is capable of printing in different dot sizes by using two nozzles with different sizes increases the variation range of the ink drop size, it increases the cost of manufacturing the printhead and the complexity of controlling the printhead.

Referring to FIG. 3, an arrangement for nozzles of the conventional image output device with ink of six colors is shown. The conventional image output device with ink of six colors includes color ink cartridges 310 and 340. The color ink cartridge 310 has a yellow ink tank Y filled with yellow ink 312, magenta ink tank M filled with magenta ink 314, and cyan ink tank C filled with cyan ink 316. The yellow ink nozzle 322 is capable of ejecting yellow ink 312, the magenta ink nozzle 324 is capable of ejecting magenta ink 314, and the cyan ink nozzle 326 is capable of ejecting cyan ink 316. The color ink cartridge 340 has a black ink tank K filled with the black ink 342, light cyan ink tank c filled with cyan ink 344, and light magenta ink tank m filled with light magenta ink 346. The black ink nozzle 352 is capable of ejecting black ink 342, the cyan ink nozzle 354 is capable of ejecting cyan ink 344, and light magenta ink nozzle 356 is capable of ejecting magenta ink 346.

Comparing FIG. 3 with FIG. 1, the light cyan ink and the light magenta ink are included in the color ink cartridge 340. This increases the tone expression and therefore enriches the color of the printed image. However, the variation range of the ink drop sizes is limited due to the uniform size of the nozzles. It is still of no help to improve image resolution.

SUMMARY OF THE INVENTION

It is therefore an object of the invention to provide an image output device for improving image resolution and tone expression by the arrangement for nozzles of the color ink cartridge of the image output device.

The invention achieves the above-identified objects by providing an image output device includes two color ink cartridges. The first color ink cartridge has a yellow ink tank Y filled with yellow ink, a first magenta ink tank M filled with magenta ink, and a first cyan ink tank C filled with cyan ink. Besides, the yellow ink nozzle is connected with the yellow ink tank Y for ejecting the yellow ink, the first magenta ink nozzle is connected with the first magenta ink tank M for ejecting the magenta ink, and the first cyan ink nozzle is connected with the first cyan ink tank C for ejecting the cyan ink. The second color ink cartridge has a black ink tank K filled with black ink, a second magenta ink tank M filled with magenta ink, and a second cyan ink tank C filled with cyan ink. Besides, the black ink nozzle is connected with the black ink tank K for ejecting the black ink, the second cyan ink nozzle is connected with the second cyan ink tank C for ejecting the cyan ink, and the second magenta ink nozzle is connected with the second magenta ink tank M for ejecting the magenta ink. When employing the image output device for printing, the color ink cartridge ink having nozzle with small diameter is driven to create small ink drops or light ink drops, and the color ink cartridge having nozzle with large diameter driven to create large ink drops or dark ink drops.

Furthermore, the image output device can have two ink color cartridge, both of which provides yellow ink, magenta ink, and cyan ink to achieve the same result by simply using different diameters of the nozzles. The image output device in the invention improves the image resolution and create a six-color tone expression. Moreover, the cost of manufacturing the printhead will not be increased and the controlling method will not become complicated.

Other objects, features, and advantages of the invention will become apparent from the following detailed description of the preferred but non-limiting embodiments. The following description is made with reference to the accompanying drawings.

DETAILED DESCRIPTION OF THE INVENTION

In the first embodiment of the invention, the image output device has a carriage and a motor. The motor drives the carriage to reciprocate along predetermined directions. An ink cartridge is mounted on the carriage and has several nozzles for ejecting ink and forming a number of ink drops. The image output device might be an ink jet printer, fax machine, or multi-function peripheral (MFP).

The image output device uses nozzles with different diameters but filled with the same color ink to increase tone expression. In the first embodiment, the image output device has two color ink cartridges. The first color ink cartridge provides yellow ink, magenta ink, and cyan ink, and the second color ink cartridge includes black ink, magenta ink, and cyan ink. In the second embodiment, the image output device has two color cartridges, both of which provide yellow ink, magenta ink, and cyan ink.

Figure 4:
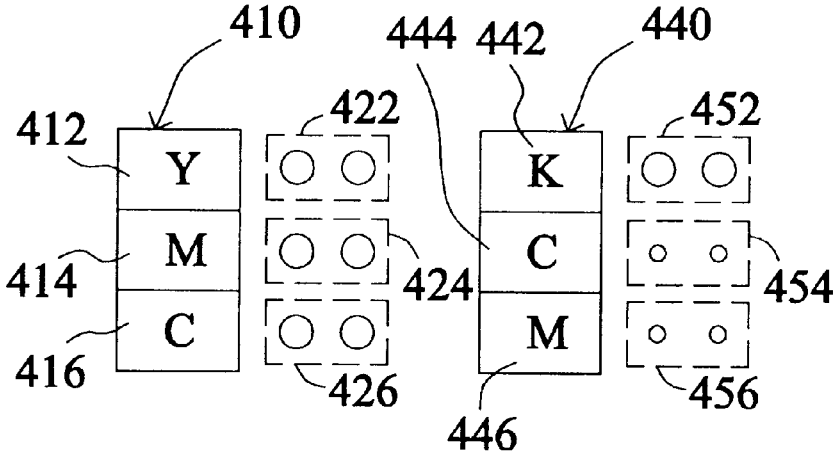
FIG. 4 shows an arrangement for printhead nozzles of the image output device according to the first embodiment of the invention.

FIG. 4 shows an arrangement for printhead nozzles of the image output device according to the first embodiment of the invention. The image output device includes two color ink cartridges 410 and 440. The first color ink cartridge 410 has a yellow ink tank Y filled with yellow ink 412, a first magenta ink tank M filled with magenta ink 414, and a first cyan ink tank C filled with cyan ink 416. Besides, the yellow ink nozzle 422 is connected with the yellow ink tank Y for ejecting the yellow ink 412, the first magenta ink nozzle 424 is connected with the first magenta ink tank M for ejecting the magenta ink 414, and the first cyan ink nozzle 426 is connected with the first cyan ink tank C for ejecting the cyan ink 416.

The second color ink cartridge 440 has a black ink tank K filled with black ink 442, a second magenta ink tank M filled with magenta ink 446, and a second cyan ink tank C filled with cyan ink 444. Besides, the black ink nozzle 452 is connected with the black ink tank K for ejecting the black ink 442, the second cyan ink nozzle 454 is connected with the second cyan ink tank C for ejecting the cyan ink 444, and the second magenta ink nozzle 456 is connected with the second magenta ink tank M for ejecting the magenta ink 446.

The cyan ink 416 of the first color ink cartridge 410 is the same as the cyan ink 444 of the second color ink cartridge 440, and the magenta ink 414 of the first color ink cartridge 410 is the same as the magenta ink 446 of the second color ink cartridge 440. Besides, the diameter of the second magenta ink nozzle 456 is smaller than a diameter of the first magenta ink nozzle 424, and the diameter of the second cyan ink nozzle 454 is smaller than the diameter of the first cyan ink nozzle 426 as well. Furthermore, the diameter of the yellow ink nozzle 422, the diameter of the first magenta ink nozzle 424, and the diameter of the first cyan ink nozzle 426 are the same. In addition, the diameter of the second magenta ink nozzle 456 is the same as the diameter of the second cyan ink nozzle 454 but smaller than the diameter of the black ink nozzle 452. Further, the diameter of the second magenta ink nozzle 456 is smaller than the diameter of the first magenta ink nozzle 424, and the diameter of the second cyan ink nozzle 454 is smaller than the diameter of the first cyan ink nozzle 426. Therefore, ink drops ejected from the second magenta ink nozzle 456 of the second color ink cartridge 440 are smaller than ink drops ejected from the first magenta ink nozzle 424 of the first color ink cartridge 410, and ink drops ejected from the second cyan ink nozzle 454 of the second color ink cartridge 440 are smaller than ink drops ejected from the first magenta ink nozzle 426 of the first color ink cartridge 410.

Figure 3:
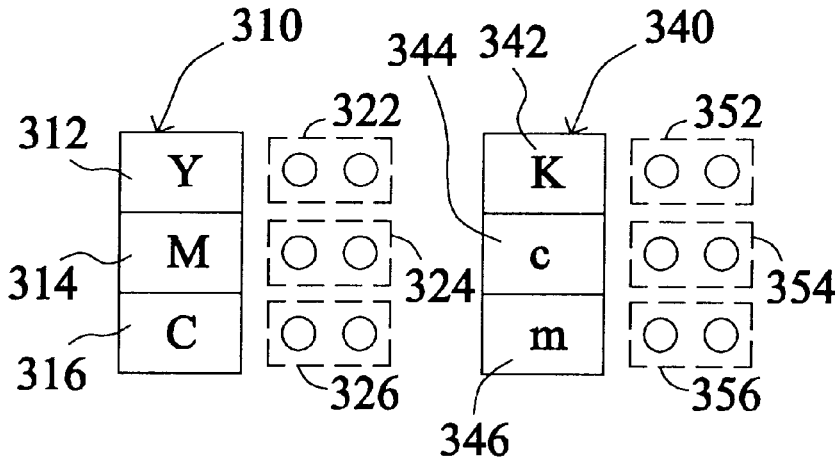
FIG. 3 (PRIOR ART)
FIG. 3 (Prior Art) shows an arrangement for nozzle of the conventional image output device with ink of six colors.

In the above-described first embodiment, the differences between the conventional ink cartridge 340 (see FIG. 3) and the ink cartridge 440 of the first embodiment (see FIG. 4) are the kinds of inks and nozzle sizes. In FIG. 4, the light cyan ink 344 and the light magenta ink 346 of FIG. 3 are replaced by cyan ink and magenta ink respectively, and the cyan ink nozzle 354 and the magenta ink nozzle 356 have smaller diameters respectively. That is to say, the color ink cartridge 440 replaces the conventional ink cartridge 340.

The smaller ink drop with the same color looks lighter due to the sense of sight. Therefore, whenever employing the image output device of the first embodiment, the cyan ink nozzle 454 or the magenta ink nozzle 456 of the color ink cartridge 440 is driven to create small ink drops or light ink drops. At the same time, the cyan ink nozzle 426 or the magenta ink nozzle 424 of the color ink cartridge 410 is driven to produce large ink drops or dark ink drops.

In the second embodiment of the invention, one color ink cartridge 540 includes yellow ink, magenta ink, and cyan ink replace the color ink cartridge 440 providing black, magenta ink, and cyan ink. The black color can be blended by the red, green, blue color. The relationship between the diameter of nozzle and the color chroma in the second embodiment is similar to the first embodiment.

Figure 5:
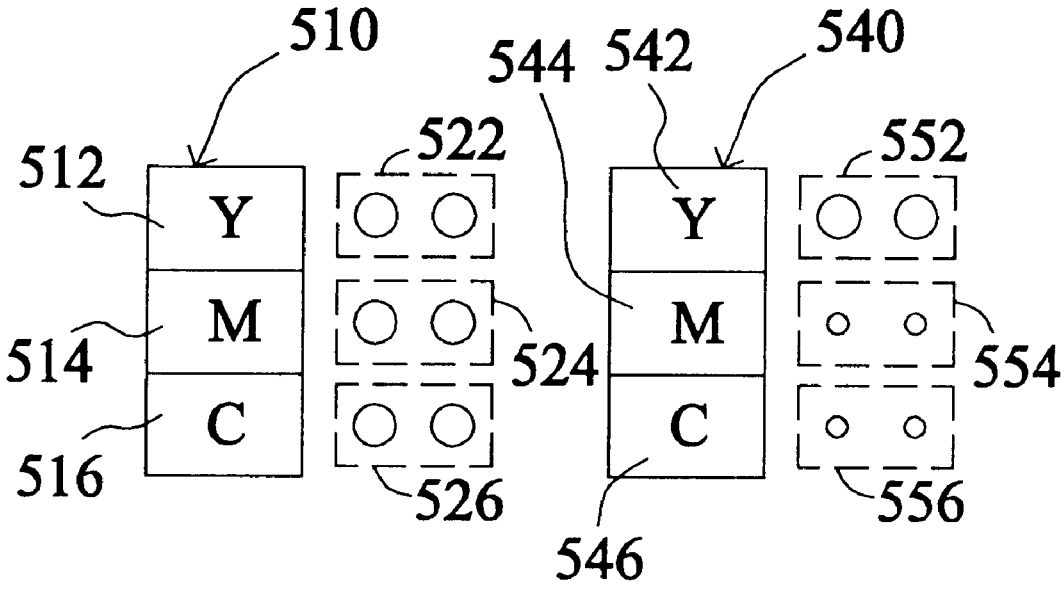
FIG. 5 shows an arrangement for printhead nozzles of the image output device according to the second embodiment of the invention.

Referring to FIG. 5, an arrangement for printhead nozzles of the image output device according to the second embodiment of the invention is shown. The first color ink cartridge 510 has a first yellow ink tank Y filled with yellow ink 512, a first magenta ink tank M filled with magenta ink 514, and a first cyan ink tank C filled with cyan ink 516. Besides, the first yellow ink nozzle 522 is connected with the first yellow ink tank Y for ejecting the yellow ink 512, the first magenta ink nozzle 524 is connected with the first magenta ink tank M for ejecting the magenta ink 514, and the first cyan ink nozzle 526 is connected with the first cyan ink tank C for ejecting the cyan ink 516. The second color ink cartridge 540 has a second yellow ink tank Y filled with yellow ink 542, the second magenta ink tank M filled with magenta ink 544, and the second cyan ink tank C filled with cyan ink 546. Besides, the second yellow ink nozzle 552 is connected with the second yellow ink tank Y for ejecting the yellow ink 542, the second magenta ink nozzle 554 is connected with the second magenta ink tank M for ejecting the magenta ink 544, and the second cyan ink nozzle 556 is connected with the second cyan ink tank C for ejecting the cyan ink 546.

The yellow ink 512 has the same color with the yellow ink 542, the magenta ink 514 has the same color with the magenta ink 544, and the cyan ink 516 has the same color with the cyan ink 546. At least two color nozzles of the color ink cartridge 540 have smaller diameter than the corresponding color nozzles of the color ink cartridge 510. As shown in FIG. 5, the diameter of the first yellow nozzle 522 and the diameter of the second yellow nozzle 552 are the same, the diameter of the first magenta ink nozzle 524 is larger than the diameter of the second magenta nozzle 554, and the diameter of the first cyan ink nozzle 526 is larger than the diameter of the second cyan nozzle 556.

Similarly, the diameter of the first magenta nozzle and the diameter of the second magenta nozzle can be the same, and at the same time, the diameter of the first cyan ink nozzle is larger than the diameter of the second cyan nozzle, and the diameter of the first yellow ink nozzle is larger than the diameter of the second yellow nozzle. On the other hand, the diameter of the first cyan nozzle and the diameter of the second cyan nozzle can be the same, the diameter of the first magenta ink nozzle is larger than the diameter of the second magenta nozzle, and the diameter of the first yellow ink nozzle is larger than the diameter of the second yellow nozzle.

Figure 1:
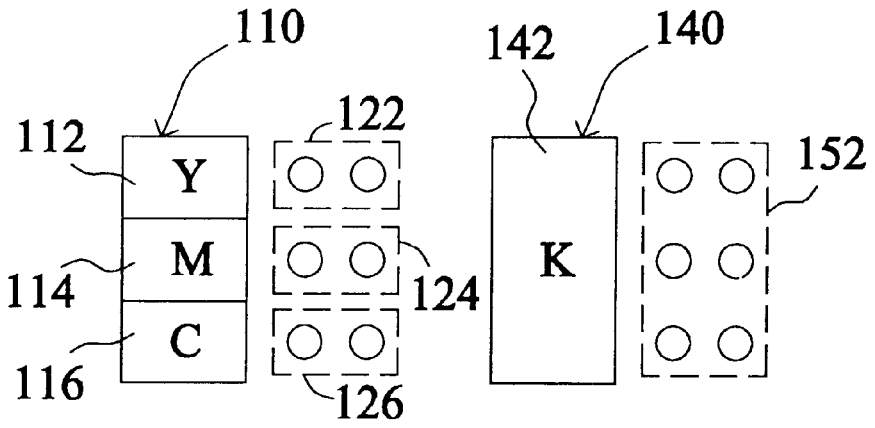
FIG. 1 (PRIOR ART)
FIG. 1 (Prior Art) shows an arrangement for nozzle of the conventional image output device with ink of four colors.
Figure 2:
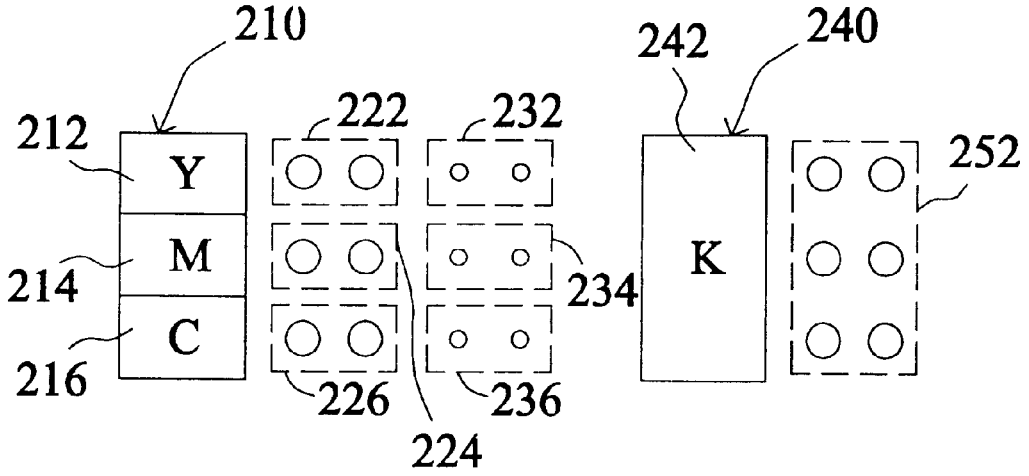
FIG. 2 (PRIOR ART)
FIG. 2 (Prior Art) shows another arrangement for nozzle of the conventional image output device with ink of four colors.

The invention uses the nozzles with different diameters but filled with the same color ink to increase tone expression. The four colors of ink can create the same tone expression with the six colors of ink and enriches the color of the printed image. Different diameters of the nozzles can increase the variation range of the ink drop size and then improve image resolution. Furthermore, the printhead according to the invention does not require two nozzles with different diameters, as shown in FIG. 2 and therefore does not require a larger wafer for manufacturing the printhead. Besides, the cost of manufacturing the printhead will not increase and the controlling method will not become complicated since there is no need to change the chip for controlling the printhead due to more nozzles.

By using the nozzles with different diameters but filled with the same color ink, the invention can reach the advantages: (1) the image resolution is improved and a six-color tone expression is created; (2) the cost of manufacturing the printhead will not increase and the controlling method will not become complicated.

While the invention has been described by way of example and in terms of embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A color ink cartridge, installed in an image output device, having a yellow ink tank filled with yellow ink, a magenta ink tank filled with magenta ink, and a cyan ink tank filled with cyan ink, the color ink cartridge further comprising:

a yellow ink nozzle, connected with the yellow ink tank, for ejecting the yellow ink;

a magenta ink nozzle, connected with the magenta ink tank, for ejecting the magenta ink; and a cyan ink nozzle, connected with the cyan ink tank, for ejecting the cyan ink, wherein a diameter of the magenta ink nozzle is different from a diameter of the yellow ink nozzle, and a diameter of the cyan ink nozzle is different from the diameter of the yellow ink nozzle.

2. The color ink cartridge according to claim 1, wherein the diameter of the magenta ink nozzle is the same as the diameter of the cyan ink nozzle but smaller than the diameter of the yellow ink nozzle.

3. The color ink cartridge according to claim 1, wherein the diameter of the magenta ink nozzle is the same as the diameter of the cyan ink nozzle but larger than the diameter of the yellow ink nozzle.

4. An image output device, comprising:

a first color ink cartridge, having a yellow ink tank filled with yellow ink, a first magenta ink tank filled with magenta ink, and a first cyan ink tank filled with cyan ink, the first color ink cartridge further comprising:

a yellow ink nozzle, connected with the yellow ink tank, for ejecting the yellow ink;

a first magenta ink nozzle, connected with the first magenta ink tank, for ejecting the magenta ink; and a first cyan ink nozzle, connected with the first cyan ink tank, for ejecting the cyan ink;

a second color ink cartridge, having a black ink tank filled with black ink, a second magenta ink tank filled with magenta ink, and a second cyan ink tank filled with cyan ink, the second color ink cartridge further comprising:

a black ink nozzle, connected with the black ink tank, for ejecting the black ink;

a second magenta ink nozzle, connected with the second magenta ink tank, for ejecting the magenta ink; and a second cyan ink nozzle, connected with the second cyan ink tank, for ejecting the cyan ink, wherein a diameter of the second magenta ink nozzle is smaller than a diameter of the first magenta ink nozzle, and a diameter of the second cyan ink nozzle is smaller than a diameter of the first cyan ink nozzle.

5. The image output device according to claim 4, wherein ink drops ejected from the second magenta ink nozzle are smaller than ink drops ejected from the first magenta ink nozzle, and ink drops ejected from the second cyan ink nozzle are smaller than ink drops ejected from the first cyan ink nozzle.

6. The image output device according to claim 4, wherein the diameter of the second magenta ink nozzle is the same as the diameter of the second cyan ink nozzle.

7. The image output device according to claim 4, wherein the image output device is one selected from a group consisting of an ink jet printer, a fax machine, and a multi-function peripheral (MFP).

8. An image output device, comprising:

a first color ink cartridge, having a first yellow ink tank filled with yellow ink, a first magenta ink tank filled with magenta ink, and a first cyan ink tank filled with cyan ink, the first color ink cartridge further comprising:

a first yellow ink nozzle, connected with the first yellow ink tank, for ejecting the yellow ink;

a first magenta ink nozzle, connected with the first magenta ink tank, for ejecting the magenta ink; and a first cyan ink nozzle, connected with the first cyan ink tank, for ejecting the cyan ink;

a second color ink cartridge, having a second yellow ink tank filled with yellow ink, a second magenta ink tank filled with magenta ink, and a second cyan ink tank filled with cyan ink, the second color ink cartridge further comprising:

a second yellow ink nozzle, connected with the second yellow ink tank, for ejecting the yellow ink;

a second magenta ink nozzle, connected with the second magenta ink tank, for ejecting the magenta ink; and a second cyan ink nozzle, connected with the second cyan ink tank, for ejecting the cyan ink, wherein a diameter of the first magenta ink nozzle is different from a diameter of the first yellow ink nozzle, and a diameter of the first cyan ink nozzle is different from the diameter of the first yellow ink nozzle.

9. The image output device according to claim 8, wherein the diameter of the first yellow ink nozzle is the same as a diameter of the second yellow ink nozzle, the diameter of the first magenta ink nozzle is larger than a diameter of the second magenta ink nozzle, and the diameter of the first cyan ink nozzle is larger than a diameter of the second cyan ink nozzle.

10. The image output device according to claim 8, wherein the diameter of the first magenta ink nozzle is the same as a diameter of the second magenta ink nozzle, the diameter of the first cyan ink nozzle is larger than a diameter of the second cyan ink nozzle, and the diameter of the first yellow ink nozzle is larger than a diameter of the second yellow ink nozzle.

11. The image output device according to claim 8, wherein the diameter of the first cyan ink nozzle is the same as a diameter of the second cyan ink nozzle, the diameter of the first magenta ink nozzle is larger than a diameter of the second magenta ink nozzle, and the diameter of the first yellow ink nozzle is larger than a diameter of the second yellow ink nozzle.

* * * * *